United States Patent [19]

Lin et al.

[11] Patent Number: 4,941,591

[45] Date of Patent: Jul. 17, 1990

[54] OFFICE-TYPE STATIONERY SET

[75] Inventors: Shuh-Chin Lin, 5, Lane 4, Alley 35, Anlo Rd., Chung-Ho, Taipei Hsien; Min-Ling Li, Taipei, both of Taiwan

[73] Assignee: Shuh-Chin Lin, Taiwan

[21] Appl. No.: 304,856

[22] Filed: Jan. 30, 1989

[51] Int. Cl.[5] ..... B65H 1/04

[52] U.S. Cl. ..... 221/100; 221/244; 221/259

[58] Field of Search ..... 221/42, 43, 213, 214, 221/230, 231, 244, 259, 260, 262, 100, 34

[56] References Cited

U.S. PATENT DOCUMENTS

| | | | |
|---|---|---|---|
| 1,446,285 | 2/1923 | Bartlett | 221/259 |
| 2,290,006 | 7/1942 | Trollen | 221/259 X |
| 2,702,145 | 2/1955 | Paulas | 221/259 X |
| 2,727,655 | 12/1955 | Pearce | 221/259 |
| 2,751,112 | 6/1956 | Bierwert | 221/244 X |

*Primary Examiner*—F. J. Bartuska

*Attorney, Agent, or Firm*—Browdy and Neimark

[57] ABSTRACT

An office-type stationery set, which comprises a basic box seat to be placed on the desk, and an upright paper holder seat, to be covered with a cover made of transparent or enlarged-functional material, and connected with the rear wall of the basic box seat. The basic box seat includes a pen-stand seat, pen-stands, paper deposit box and paper dispensing device. The paper dispensing device is upright set on the lid of the paper deposit box comprising a button, a connecting rod, a pushing rod, and a pushing wheel. When the button is pressed, the driving rod will be oriented downwards and therefore push the connecting rod, to be responsive in movement to make the pushing rod which is pivoted on its front end, to move forward. The pushing wheel on the rear end of the pushing rod will not roll, as a ratchet is set to be an obstruction, but will rub on the paper and by frictional force push it out of the box. When the button is up, the spring within the paper dispensing device will return to a former state, and the pushing wheel on the front end of the pushing rod will roll back. In this way, it will not pull back the paper that is ready to be sent out. With the present invention it is possible by merely pressing the button, to send out one piece of paper will be sent out at the same time.

3 Claims, 3 Drawing Sheets

A-A SECTION

B-B SECTION

X VIEW

OFFICE-TYPE STATIONERY SET

FIELD OF THE INVENTION

This present invention relates to an office-type stationery set, and more particularly to a stationery set which groups paper, paper deposit box, pen, pen-stands, and a paper holder seat in one set, which is convenient to use and will make it possible to avoid any disorder or messes on the desk, and therefore provide a pleasant working environment.

BACKGROUND OF THE INVENTION

Stationery supplies as memo sheets, pen-stands, paper holder seat and paper deposit boxes in general applied to office work are set separately on the desk or in the drawer such that they may not only occupy a lot of room on the desk or in the drawer in a disorderly manner, but also it may take time for users to find them all together for use. In addition, notes taken on memo sheets or daily books for future reference are also inconvenient for people to find to look at them in any time. Besides, memo sheets usually need to be pressed under a paperweight. This not only occupies more room of the desk, but with careless pushing of the weight, the sheets may be fly off in the wind. Although fixing notes beneath a glass plate over a desk, it can be seen clearly and right away, yet, it is still a bother either to put in or take out the paper from under the glass plate.

OBJECTS OF THE INVENTION

Therefore, it is an object of this present invention to solve the afore-mentioned difficulties and to provide an office-type stationery set, which has features as follows.

This invention groups stationery supplies in one set, which only takes up a small room of the desk and is convenient and time-saving for users to reach it for use. Also, it makes the desk look clean, since the stationery supplies are set in order.

By merely pressing the button of the paper dispensing device, one piece of paper will be sent out of the box, and users need not search around for paper.

The upright paper holder seat has at its front, a transparent or enlarged-functioned cover such that through the cover the content of paper within the paper holder seat can be seen clearly and immediately.

The cover above the paper holder seat reaches below the latter such that it makes it easy to insert or remove paper from the paper holder seat.

Paper that is kept within the paper holder seat will not be blown off or become dirty.

SUMMARY OF THE INVENTION

The above objects are achieved by an office-type stationery set, which comprises: a basic box seat to be placed on the desk, one or more pen-stands that are set on the pen-stand seat which are located on the right portion of the basic box seat, a number of memo sheets contained within the paper deposit box which is on the left portion of the basic box seat, a paper dispensing device set on the top of the box lid, and a paper holder seat having at a front portion, a transparent or enlarged-functioned cover and upright connected with the rear wall of the basic box seat. To take a memo sheet, users merely press the button of the paper dispensing device, then a piece of paper will be sent out, while taking a pen from the pen-stand for use and finding what is written down need to be read at any time, users may insert the paper into the paper holder seat, through its fronted transparent or enlarged-functioned cover and the writing content remains for instant reading at any moment.

SPECIFIC DESCRIPTION

Figure 1:
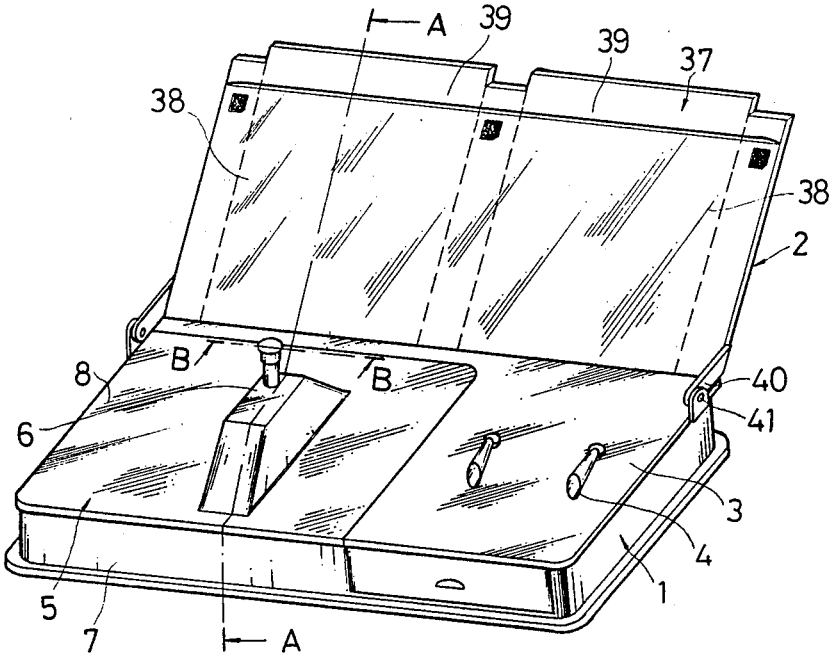
FIG. 1 is an external prospective view, illustrating the structure of the present invention.
Figure 2:
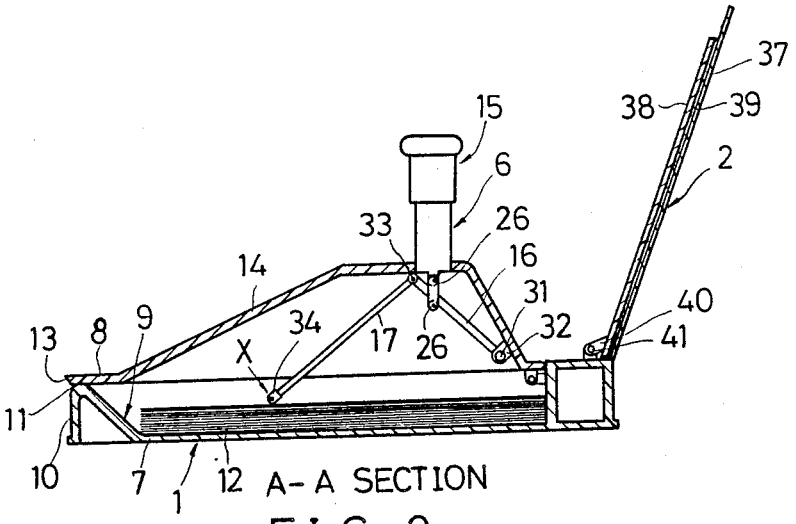
FIG. 2 is a cross-sectional view taken along line A—A in FIG. 1.
Figure 3:
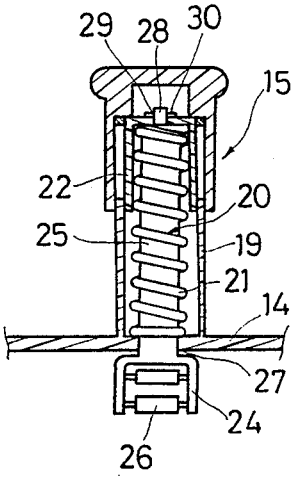
FIG. 3 is an enlarged cross-sectional view taken along line B—B in FIG. 1.
Figure 4:
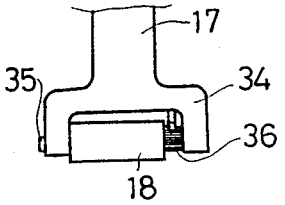
FIG. 4 is an enlarged view on marked position X in FIG. 2.

Referring now to the drawings, as shown in FIGS. 1 and 2, the present invention comprises a basic box seat 1 to be placed on the desk and, a paper holder seat 2 connected upright with the rear wall of the basic box seat 1. The basic box seat 1 comprises a pen-stand seat 3, pen-stand 4, paper deposit box 5 and a paper dispensing device 6. The basic box seat has a rectangle form, however, it may be in any other shape. Pen-stand seat 3 forms the right portion of the box seat 1 and one or more pen-stands are provided thereon for the insertion of pens or pens of various colors (not shown in Figs.). Beneath the pen-stand seat, there may be set a drawer the structure of which is well understood by those skilled in the art, and so it will not be described herein. On the left portion of the basic box seat 1 is a paper deposit box 5 which comprises a housing 7, a box lid 8 and a paper dispensing device 6. In FIG. 2, a housing 7 is shown designed a little bigger than the size of the paper sheet in order to be able to receive the sheets therein. Within the housing, there is a proper slope 9 bridged between the paper and the front wall of the box, along which the paper will rise and be sent out through the chink 11 set between the top rim of the front wall 10 and the cover lid 8. The rear end of the cover lid 8 is connected to the housing 7 by means of a pin, and on the bottom surface of its front end, there is a slight slope 13 upwards which is provided to lead the paper when it is being pushed outwardly. In the middle of the cover lid 8 is a protrusion 14, which contains part of the paper dispensing device. The paper dispensing device comprises a button 15, a connecting rod 16, a pushing rod 17 and a pushing wheel 18. The button 15 is connected with the hollow cylinder 19 above the protrusion 14, as shown in FIG. 3, and comprises a driving rod 20, spring 21, a pressing cylinder 22 and a knob 23, wherein the driving rod 20 is long and flat, having a rear end of inverted U-shaped connecting fork 24 wider than the rod 25. Within the connecting fork 24 are two rollers 26 spaced parallel from each other and perpendicular to the connecting fork 24. A connecting rod 16 extends between the rollers 26. The shaft 25 above the connecting fork 24 goes through the hole 27 on the bottom plate on the hollow cylinder 19 and is entangled by spring 21. A pressing cylinder 22 is set upon shaft 25. The pressing cylinder 22 has a hole 29 on its top which permits the locking slot 28 on the top of the shaft 25 to go through and to connect with a c-locking spring 30 such that the driving rod remains in its proper orientation. The knob 23, having an opening at the rear end, sleeves on the top of the pressing cylinder 22. When a force acts on the knob 23, the spring 21 will be compressed to drive the driving rod 20 to move downwards, and after the force is released, the driving rod will return to its original position. The connecting rod 16 is a flat and long shaft, as shown in FIG. 2, having a rear end pivoted to the connecting ear 32, which is set on the internal rear end of protrusion 14 above the cover lid 8, at pin 31. The rod 16 has a front end which passes between the two parallel rollers 26, which are on the rear end of the driving rod 20. When the driving rod 20 is actuated to move downwards, it will also make the connecting rod 16 swivel at pin 31 and thus descend. The front end of the connecting rod 16 is hinged on the pushing rod 17 by a pin 33. The pushing rod 17 is also a flat and long shaft, having an inverted U-shaped fork 34 on the front end (as shown in FIG. 4), which contains within a pushing wheel 18 on an axle 35. The pushing wheel 18 is made of material having high frictional force (such as rubber). On one end of axle 35, there is a ratchet 36, which can prevent the pushing wheel 18 from rolling forth. The pushing wheel 18 will roll only when it retreats, but it will not pull back the paper which is just ready to be sent out. The paper will be sent out only by the high-frictional force caused by the contact of the pushing wheel 18 and the paper itself.

As FIGS. 1 and 2 illustrated, on the rear wall of the basic seat 1 is an upright paper holder seat 2 with a slight slope backwards. The paper holder seat 2 is composed of a holder plate 37 and a cover 38, wherein holder plate 37 contains within one or more hollow portions 39 which may be filled with paper; on each corner of its rear edge there is a connecting ear 40, which are adopted to receive a pin 41. The length of the cover 38 is shorter than the holder plate 37 so as the insertion or removal of paper is convenient. Further, the cover is made of transparent or enlarged-functioned material, through which the content of the paper can be seen to be read. The upper sides of the cover 38 can be joined to the holder plate by means of magnet 42 or any locking hook.

Figure 5:
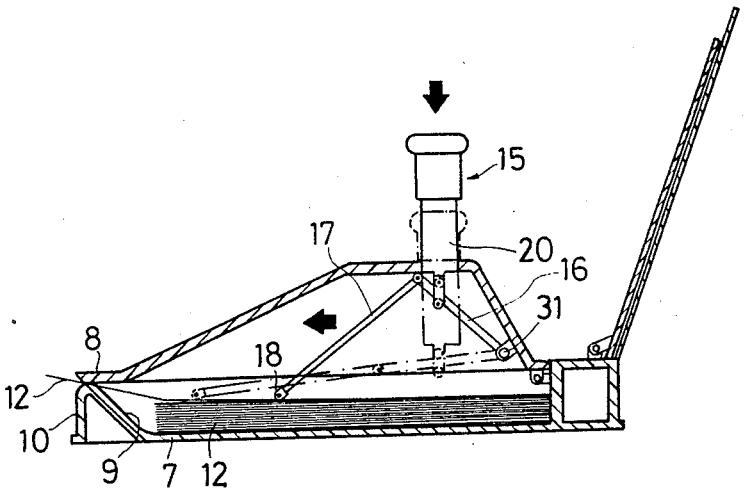
FIG. 5 is a schematic view, showing the operation of the paper dispensing device of the present invention.

The use and operation of the present invention are as follows. The stationery set can be placed in the front part of the desk. To use it (as shown in FIG. 5), the button 15 is pressed, thus causing the driving rod 20 to be actuated to move downwards and make the connecting rod 16 turn counterclockwise at pin 13 such that pushing rod 17 is directed to push one piece of paper sheet 12 out by the strong frictional force produced between the pushing wheel 18 and paper 12. Then the paper will rise up along the slope 9 and pass through the chink 11 set between the top rim of the front wall 10 and the cover lid 8. Releasing the button 15, will cause the spring to extent, the driving rod 20 to return to its original position, and pushing rod 17 to turn back also to its original position to wait for the next performance.

We claim:

1. An office-type stationery set, which comprises:
   - a basic seat to be placed on a desk; said seat having a front wall and a rear wall, the basic seat including:
     - at least one pen-stand set on a top of a pen-stand seat to one side of the basic seat,
     - a paper deposit box on one portion of the basic seat adapted to hold at least one memo sheet, said box having a lid and a slope on an inner front end permitting the at least one memo sheet to uprise along and pass through a chink between a top rim of the front wall and the lid, and,
     - a paper dispensing device connected with a protrusion on the lid of the paper deposit box;
   - an upright paper holder seat connected on the rear wall of the basic seat for removably receiving selected ones of said at least one memo sheet.

2. The paper dispensing device as recited in claim 1, further comprising:
   - a button connected on the top of the protrusion on the lid, said button comprising:
     - a driving rod having an inverted U-shaped first fork winder at one end, the first fork containing two parallelly spaced rollers perpendicular to the fork,
     - a spring disposed coaxially surrounding the driving rod,
     - a pressing cylinder surrounding said spring, and
     - a knob connected to the cylinder adapted to be pressed by a user;
   - a connecting rod set between the two parallelly spaced rollers, having a first end and a second end, the second end pivotally connected with the protrusion on the lid;
   - a pushing rod having a first end connected with the first end of the connecting rod, having an inverted U-shaped second fork on a second end, the second fork containing therein a pushing wheel by means of an axle, the pushing wheel being made of material of high frictional force;
   - a ratchet connected with one end of the axle, which can stop forward movement of the pushing wheel and permit rearward rolling thereof; and
   - wherein, by pressing on the button, one piece of paper will be sent out for use at a time.

3. The paper dispensing device as recited in claim 1, wherein said paper holder seat is transparent such that the selected sheets of paper received therein can be read.

* * * * *